US011202520B2

(12) United States Patent
Musiiwa

(10) Patent No.: US 11,202,520 B2
(45) Date of Patent: Dec. 21, 2021

(54) BABY CARRIER

(71) Applicant: Sibusisiwe Musiiwa, Edmonton (CA)

(72) Inventor: Sibusisiwe Musiiwa, Edmonton (CA)

( * ) Notice: Subject to any disclaimer, the term of this patent is extended or adjusted under 35 U.S.C. 154(b) by 0 days.

(21) Appl. No.: 16/849,061

(22) Filed: Apr. 15, 2020

(65) Prior Publication Data

US 2020/0337475 A1 Oct. 29, 2020

(51) Int. Cl.
*A47D 13/02* (2006.01)
*A44B 11/25* (2006.01)

(52) U.S. Cl.
CPC ..... *A47D 13/025* (2013.01); *A44B 11/2503* (2013.01)

(58) Field of Classification Search
CPC ..... A47D 13/02; A47D 13/025
USPC ..... 224/158–160
See application file for complete search history.

(56) References Cited

U.S. PATENT DOCUMENTS 4,009,808 A * 3/1977 Sharp ..... A47D 13/025 224/160
4,139,131 A * 2/1979 Hathaway ..... A47D 13/025 224/160
D253,558 S * 12/1979 Carter ..... D3/214
4,434,920 A * 3/1984 Moore ..... A47D 13/025 224/160
4,436,233 A * 3/1984 Hill ..... A47D 13/025 224/159
4,469,259 A * 9/1984 Krich ..... A47D 13/025 224/159
4,986,458 A * 1/1991 Linday ..... A47D 13/025 224/160
5,678,739 A 10/1997 Darling et al.
6,009,839 A * 1/2000 Kohn ..... A47D 13/086 119/770
D425,696 S * 5/2000 Swanke ..... D3/213
D507,869 S * 8/2005 Liistro ..... D3/213
D614,861 S 5/2010 Smyth et al.
8,172,116 B1 5/2012 Lehan et al.
9,314,113 B1 4/2016 Lehan
D833,735 S * 11/2018 Hauser ..... D3/214
10,426,275 B2 * 10/2019 Telford ..... A47D 13/025
2007/0278264 A1 12/2007 Chesal et al.
2011/0163136 A1 7/2011 Billingham
2011/0290831 A1 12/2011 Wang
2012/0199619 A1 * 8/2012 Zack ..... A47D 13/025 224/160
2014/0319189 A1 10/2014 Hoppener-Visser

OTHER PUBLICATIONS

Photo of Mifanqi carrier located; Sep. 15, 2018; 1 page.
Google Image Search for "Back Pack with Chest Strap"; Sep. 21, 2018; p. 1-64.
Final Official Action for U.S. Appl. No. 13/368,981 dated Apr. 8, 2015.

* cited by examiner

*Primary Examiner* — Adam J Waggenspack
(74) *Attorney, Agent, or Firm* — Burdick Patents, P.A.; Sean D. Burdick

(57) ABSTRACT

A baby carrier has a baby pouch, waistband, side straps and shoulder straps. The baby pouch has an adjustable size and may have an adjustable headrest. The baby carrier provides an efficient way of carrying a child by keeping the child's weight close to the user's body.

7 Claims, 5 Drawing Sheets

BABY CARRIER

TECHNICAL FIELD

Baby Carriers

BACKGROUND

There are many various infant and baby carriers available on the market for parents and other caregivers to carry babies and infants while keeping the caregiver's hands free. Many of these are constructed with support straps going over the wearer's shoulders, putting strain on the user's shoulders.

SUMMARY

A baby carrier has a baby pouch, a pair of shoulder straps extending from opposite sides of an upper portion of the pouch, a waistband extending from opposite sides of a lower portion of the pouch and side straps extending from respective sides of the pouch intermediate the shoulder straps and waistband, the side straps being configured to couple together.

In various embodiments, there may be included any one or more of the following features: the shoulder straps are configured to be secured to each other by tying; an adjustable height headrest; the baby pouch forms an adjustable seat for a child; the baby pouch comprises a drawstring; the waistband comprises an adjustable buckle; the side straps are configured to couple together by an adjustable buckle.

These and other aspects of the device and method are set out in the claims.

BRIEF DESCRIPTION OF THE FIGURES

Embodiments will now be described with reference to the figures, in which like reference characters denote like elements, by way of example, and in which.

DETAILED DESCRIPTION

Immaterial modifications may be made to the embodiments described here without departing from what is covered by the claims.

A baby carrier 10 is wearable to secure a baby or infant to a user. The baby carrier provides an efficient way of carrying a child by keeping the weight of the child close to the body of the user. The baby carrier may be used to carry a baby or infant in a front carry, side carry or back carry position.

Figure 1:
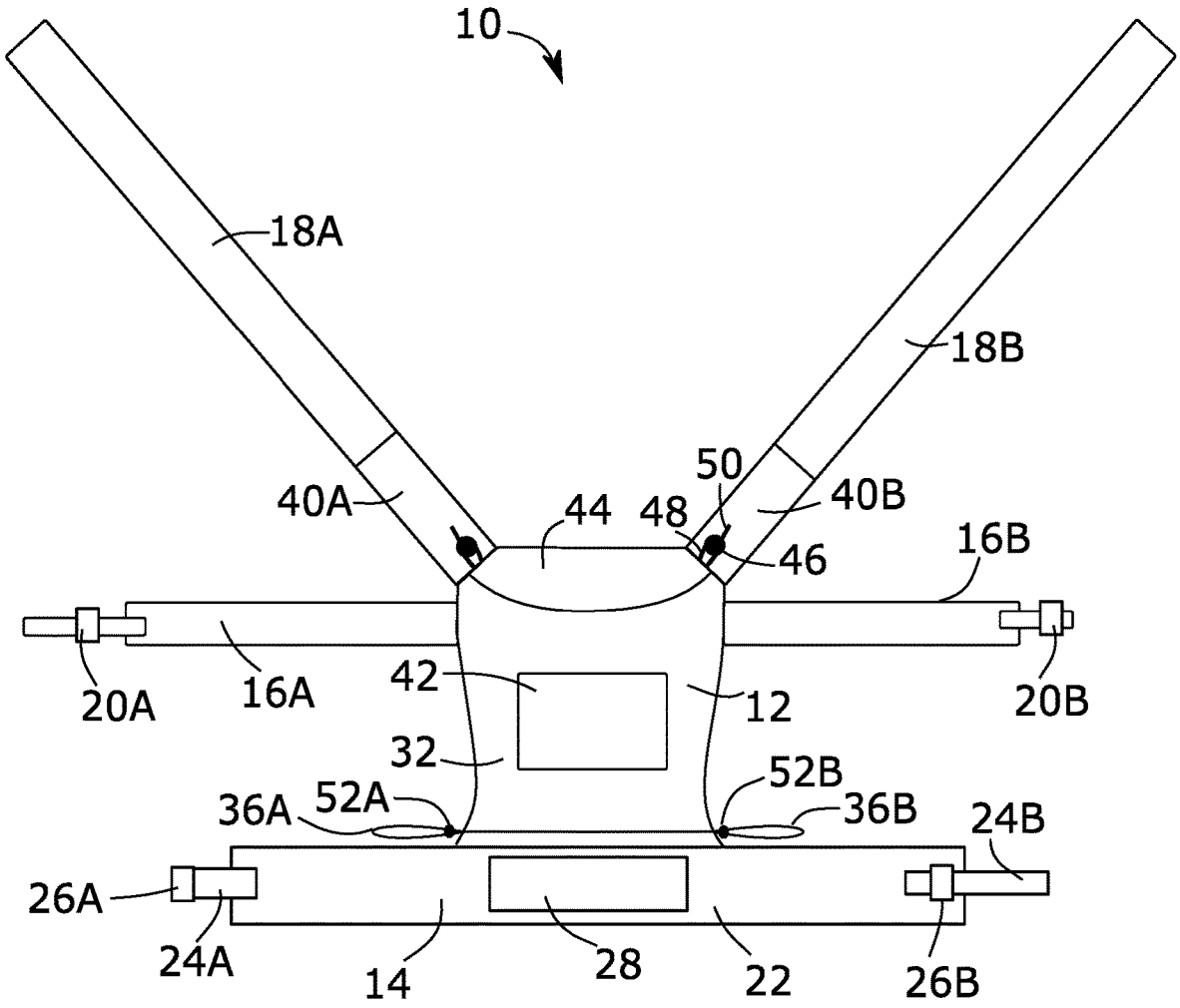
FIG. 1 shows an outer side of a baby carrier laid flat with the headrest folded.
Figure 2:
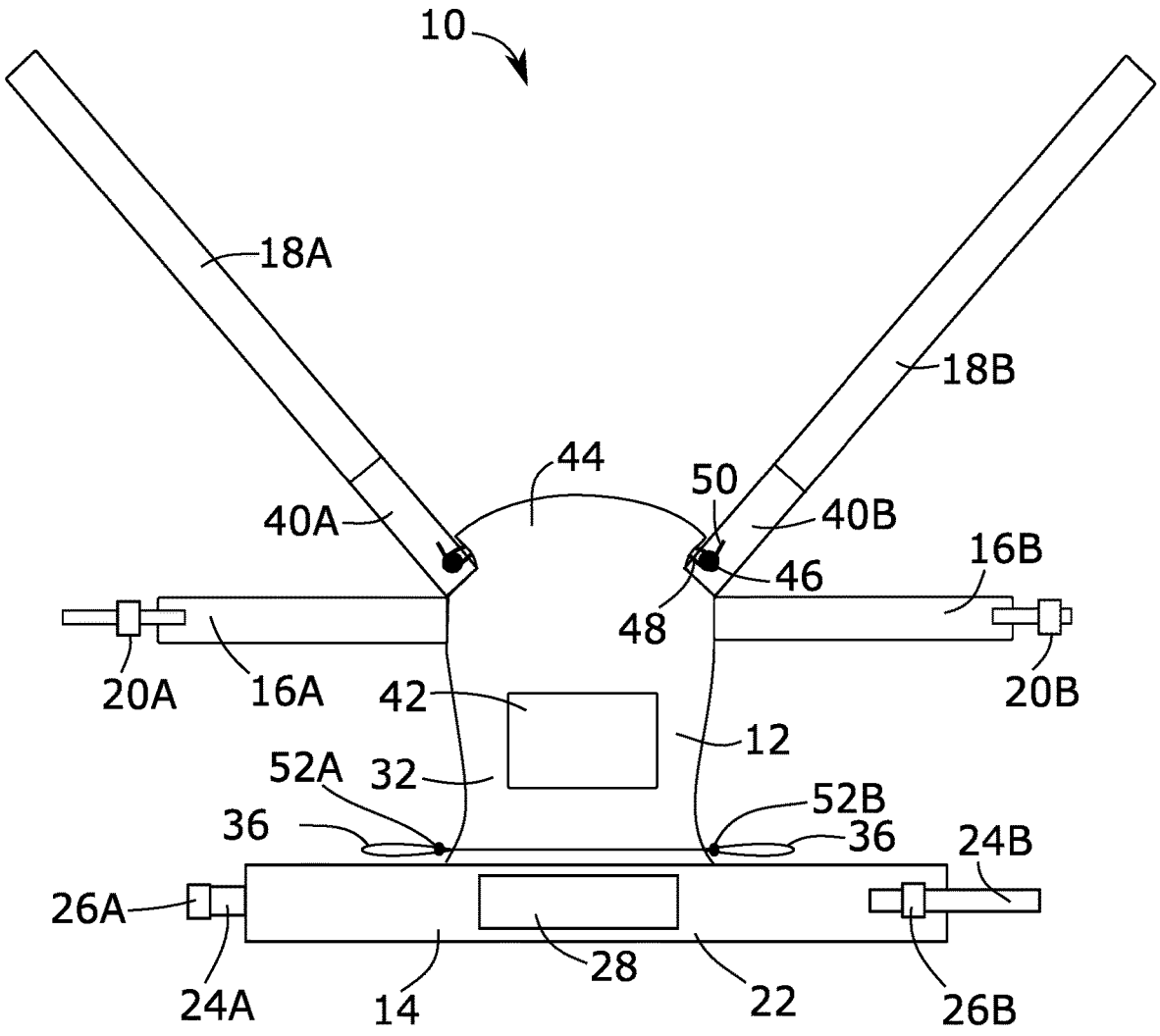
FIG. 2 shows the baby carrier of FIG. 1 with the headrest unfolded.

The baby carrier comprises a baby pouch 12, waistband 14, side straps 16A and 16B and shoulder straps 18A and 18B as shown in FIGS. 1 and 2. The waistband 14 extends from opposite sides of a lower portion of the baby pouch 12, the shoulder straps 18A and 18B extend from opposite sides of an upper portion of the baby pouch 12, and the side straps

16A and 16B extend from respective sides of the baby pouch 12 intermediate the shoulder straps 18A and 18B and the waistband 14. The shoulder straps, side straps and waistband are secured to the baby pouch 12 and may be sewn to the baby pouch 12.

Multiple straps may be used to decrease the strain on the user's shoulders, allowing the user to comfortably carry the child for long periods of time. The baby is held between the body of the user and the baby pouch 12. Side straps offload weight from the shoulder straps and redistribute it around the user's torso and hips such that there is minimal to no weight bearing through the shoulders.

The side straps help to make the carrier a safe option for use with children with low trunk tone and babies who cannot yet sit upright unaided. The side straps allow the baby pouch to be positioned such that the child's trunk and pelvis are held in a neutral position. The opening created between the side straps and the waistband on either side of the pouch is preferably large enough for the child's legs to comfortably fit through, but too small for the child to slip out of the pouch. The side straps may also help to reduce lateral sway of the child on the user's back.

One end of each side strap 16A and 16B is secured to the baby pouch 12. The other end of each side strap 16A and 16B is adjustably and detachably connectable to the other of the side straps 16A and 16B. The side straps are configured to couple together, for example through a fastener. The fastener may comprise a first connector 20A on side strap 16A and a second connector 20B on side strap 16B. Side straps 16A and 16B are preferably configured to have an adjustable length. The length may be adjustable by sliding the first or second connector along the length of the side strap, so the side straps may be secured snugly around the wearer, for example the wearer's chest. Side straps 16A and 16B may be padded.

Figure 3:
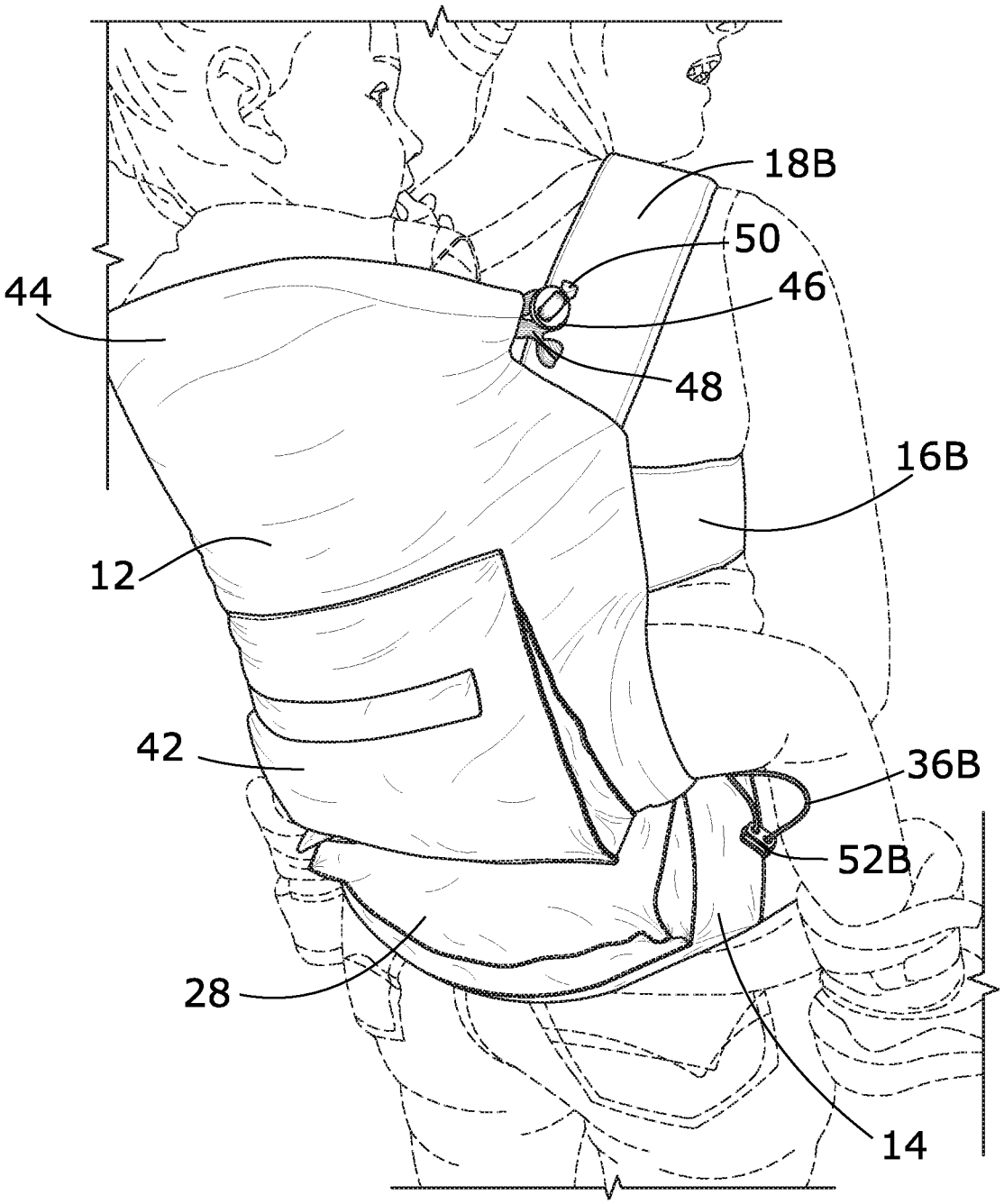
FIG. 3 is a perspective view of a baby carrier in a back-carry position.
Figure 4:
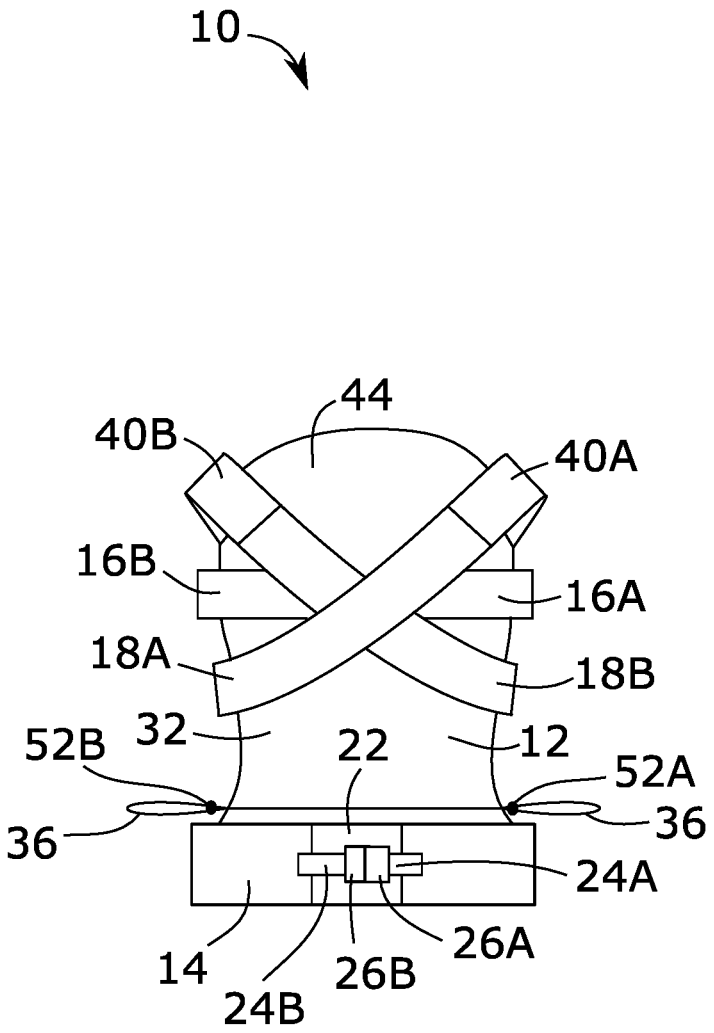
FIG. 4 shows a baby carrier in an example carry configuration with the side straps placed under the shoulder straps.
Figure 5:
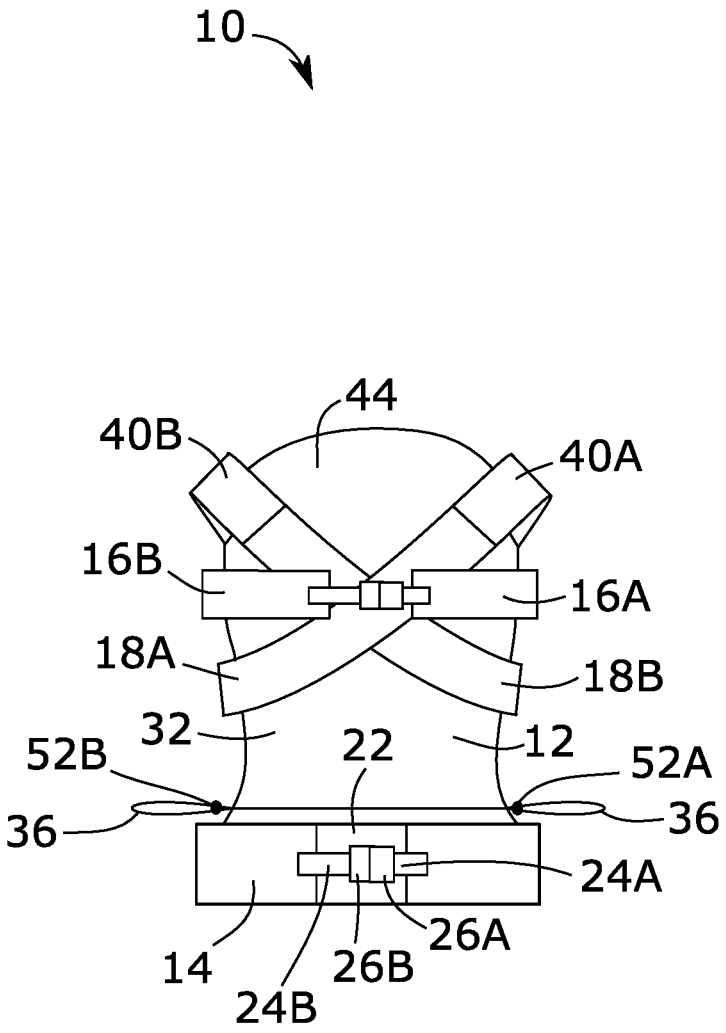
FIG. 5 shows a baby carrier in an example carry configuration with the side straps placed over the shoulder straps.

Preferably separate from side straps 16A and 16B are shoulder straps 18A and 18B. The shoulder straps are preferably designed to fit any body shape and may be padded at or near an end of the shoulder straps that is secured to the baby pouch, so that the portion 40 of the shoulder strap that extends over the user's shoulders is padded. The shoulder straps 18A and 18B may be detachably connectable to the other of the shoulder straps 18A and 18B, for example by tying. The shoulder straps may alternatively be coupled together through a fastener. Each shoulder strap 18A and 18B is long enough to wrap fully around the user and be comfortably connected to the other shoulder strap. In an example method of tying the shoulder straps in a back-carry position, shown in FIG. 3, each shoulder strap extends over a shoulder of the user and crosses the body, so the shoulder straps 18A and 18B cross each other near the center of the body forming an X shape. Each shoulder strap then extends behind the user and is tied to the other shoulder strap below where the child is seated. For comfort the shoulder straps are preferably wrapped and tied so they lay as flat as possible across the body. The shoulder straps may be wider than the side straps to spread out the load. The shoulder straps may be tied in a similar crossing fashion for a front or side carry. The side straps 16A and 16B may be coupled together before or after the shoulder straps 18A and 18B are wrapped and connected. The side straps may lay over or under the shoulder straps in use. Example carry/in use configurations are shown in FIGS. 4 and 5. The waistband straps are shown coupled together. FIG. 4 shows the carrier as it could be worn in use with the side straps 16A and 16B being coupled together underneath the shoulder straps 18A and 18B. FIG.

5 shows the carrier as it could be worn in use with the side straps 16A and 16B being coupled together over the shoulder straps 18A and 18B.

Waistband 14 is worn around the user's waist or hips. The waistband 14 comprises a body portion 22 and straps 24A and 24B. The straps 24A and 24B extend from opposing sides of the body portion 22 and are adjustably and detachably connectable to the other strap 24A or 24B. The straps 24A and 24B are configured to couple together, for example through a fastener. The fastener may comprise a first connector 26A on strap 24A and a second connector 26B on strap 24B. The length of the waistband 14 is adjustable by sliding the first connector 26A and/or second connector 26B along the respective strap 24A or 24B, so the waistband 14 may be secured snugly around the wearer's hips. The waistband 14 may be padded.

Waistband 14 may include a pocket 28. The waistband 14 may have an additional detachable pocket pouch connected to the waistband to hold smaller items, for example, diapers, wipes, keys and a phone.

The fastener in this description may be any sort of mechanical fastener, for example a buckle, for example a male and female type buckle. Other mechanical fasteners may be used such as loop buckles, D-ring buckles, hook and loop fasteners, ties, buttons, snaps, etc.

The baby pouch 12 comprises a panel 32. The panel 32 may be height adjustable, designed to grow with the child, and is large enough to hold the baby, infant or small child in a seated position. The child sits in a seat created by the panel with their legs extending through openings defined by the waistband 14 and the side straps 16A and 16B. The size of the seat may be adjustable by a drawstring 36 provided at a lower end of the panel 32. The drawstring 36 may be elastic and may include stoppers 52A and 52B at either end of the drawstring 36 to maintain tension in the drawstring 36. The panel is preferably configured to create a wide seat width and depth, which helps maintain blood circulation in the child's legs by ensuring they are fully supported. Panel 32 may have a pocket 42 on the outside of the panel to carry small items.

There may be a headrest 44 at an upper portion of the panel 32. The headrest 44 may be padded but the padding is preferably arranged so the headrest 44 may be folded to adjust the height of the headrest depending on the size of the child. The headrest 44 is shown in an example folded position in FIG. 1, for smaller children, and in an example unfolded position in FIG. 2, for larger children. The headrest 44 may be removably fastened to the shoulder straps 18A and 18B. This may be through a button 46 attached to a shoulder strap that passes through a loop 48 on a side edge of the headrest. The button 46 may be slidable on a button strap 50 on the shoulder strap 18A or 18B to allow fine adjustments to the height of the headrest 44. The shoulder straps preferably extend from the upper portion of the panel on either side of the headrest.

The carrier may be used to carry small young children, toddlers or babies. The carrier, and especially the baby pouch, is preferably constructed from a strong, structured fabric to offer durability for older babies. The carrier may also be used to safely carry children and babies with low trunk tone, keeping the child's trunk and pelvis in a neutral position, as well as babies who are unable to sit upright unaided. The side straps are positioned on the baby pouch such that there is no opening wide enough for the baby to fall through, allowing a child with low trunk tone to be carried safely and securely on the user's back, front and side.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A baby carrier comprising:

a baby pouch;

a pair of shoulder straps extending from opposite sides of an upper portion of the pouch;

a waistband extending from opposite sides of a lower portion of the pouch; and weight-bearing side straps extending from respective sides of the pouch intermediate the shoulder straps and waistband, the side straps being configured to couple together, the side straps configured so that there is minimal to no weight bearing through the shoulder straps when worn.

2. The baby carrier of claim 1 wherein the shoulder straps are configured to be secured to each other by tying.

3. The baby carrier of claim 1 further comprising an adjustable height headrest.

4. The baby carrier of claim 1 in which the baby pouch forms an adjustable seat for a child.

5. The baby carrier of claim 4 in which the baby pouch comprises a drawstring.

6. The baby carrier of claim 1 in which the waistband comprises an adjustable buckle.

7. The baby carrier of claim 1 in which the side straps comprise an adjustable buckle configured to couple the side straps together.

* * * * *